US012478830B2

(12) United States Patent
Aoki et al.

(10) Patent No.: US 12,478,830 B2
(45) Date of Patent: Nov. 25, 2025

(54) LOWER LIMB EXERCISE EQUIPMENT AND PEDAL UNIT

(71) Applicant: TOYOTA JIDOSHA KABUSHIKI KAISHA, Toyota (JP)

(72) Inventors: Eisuke Aoki, Toyota (JP); Tomio Ikeda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 325 days.

(21) Appl. No.: 18/125,915

(22) Filed: Mar. 24, 2023

(65) Prior Publication Data

US 2023/0330483 A1 Oct. 19, 2023

(30) Foreign Application Priority Data

Apr. 14, 2022 (JP) ..... 2022-066750

(51) Int. Cl.

| | |
|---|---|
| ***A63B 22/20*** | (2006.01) |
| ***A63B 21/00*** | (2006.01) |
| ***A63B 22/00*** | (2006.01) |
| ***A63B 22/16*** | (2006.01) |
| ***A63B 23/08*** | (2006.01) |
| ***A63B 23/10*** | (2006.01) |

(52) U.S. Cl.

CPC ..... *A63B 22/20* (2013.01); *A63B 21/4034* (2015.10); *A63B 22/201* (2013.01); *A63B 23/08* (2013.01); *A63B 22/0046* (2013.01); *A63B 22/16* (2013.01); *A63B 23/10* (2013.01)

(58) Field of Classification Search

CPC . A63B 21/4034; A63B 22/0046; A63B 22/16; A63B 22/20; A63B 22/201; A63B 23/08; A63B 23/10

See application file for complete search history.

(56) References Cited

U.S. PATENT DOCUMENTS

| | | | | |
|---|---|---|---|---|
| 6,821,235 | B1 * | 11/2004 | Johnson | A63B 21/4015 482/79 |
| 10,589,141 | B2 * | 3/2020 | Shimizu | A63B 22/14 |
| 2006/0084554 | A1 * | 4/2006 | Bement | A63B 22/18 482/79 |
| 2018/0318639 | A1 * | 11/2018 | Kim | A63B 22/0046 |
| 2022/0339490 | A1 * | 10/2022 | Vaudreuil | A63B 23/04 |

FOREIGN PATENT DOCUMENTS

| | | | |
|---|---|---|---|
| CN | 105310862 | A | 2/2016 |
| CN | 106669100 | A | 5/2017 |
| JP | 2003-245376 | A | 9/2003 |
| JP | 2004-261256 | A | 9/2004 |

(Continued)

*Primary Examiner* — Megan Anderson
(74) *Attorney, Agent, or Firm* — Oliff PLC

(57) ABSTRACT

Supination and pronation of an ankle joint during a lower limb exercise is achieved. A foot-pedaling exercise equipment as a lower limb exercise equipment is a lower limb exercise equipment that enables a lower limb exercise to be performed using a pair of pedal units. Each of pedal units includes: a step part on which a corresponding foot part can be put; a base part; and a joint part that is provided between the step part and the base part and couples the step part to the base part in such a way that the step part can do a pitch turn, a roll turn, and a yaw turn with respect to the base part.

4 Claims, 5 Drawing Sheets

(56) References Cited

FOREIGN PATENT DOCUMENTS

| | | | |
|---|---|---|---|
| JP | 2005-312922 | A | 11/2005 |
| JP | 2006-526456 | A | 11/2006 |
| JP | 4112574 | B2 | 7/2008 |
| JP | 2018-099502 | A | 6/2018 |
| WO | 2004/108223 | A1 | 12/2004 |

* cited by examiner

LOWER LIMB EXERCISE EQUIPMENT AND PEDAL UNIT

CROSS REFERENCE TO RELATED APPLICATIONS

This application is based upon and claims the benefit of priority from Japanese patent application No. 2022-066750, filed on Apr. 14, 2022, the disclosure of which is incorporated herein in its entirety by reference.

BACKGROUND

The present disclosure relates to a lower limb exercise equipment and a pedal unit.

Patent Document 1 (Published Japanese Translation of PCT International Publication for Patent Application No. 2006-526456) discloses a stepping exercise equipment that enables plantarflexion and dorsiflexion of an ankle joint and inversion and eversion of the ankle joint.

Patent Document 2 (Japanese Unexamined Patent Application Publication No. 2004-261256) discloses an ankle exercise apparatus that enables plantarflexion and dorsiflexion of an ankle joint and internal and external rotations of the ankle joint.

SUMMARY

By the way, when walking, ankle joints (talocrural joint and subtalar joint) repeat supination and pronation alternately.

Here, supination of an ankle joint is a complex movement consisting of plantarflexion in the sagittal plane, internal rotation in the transverse plane, and inversion in the frontal plane. Pronation of an ankle joint, on the other hand, is a complex movement consisting of dorsiflexion in the sagittal plane, external rotation in the transverse plane, and eversion in the frontal plane.

In the configurations of Patent Documents 1 and 2 above, the supination and pronation mentioned above during a lower limb exercise cannot be achieved.

Therefore, an aim of this disclosure is to provide a technique for achieving supination and pronation of an ankle joint during a lower limb exercise.

According to a first aspect of this disclosure, a lower limb exercise equipment that enables a lower limb exercise to be performed using a pair of pedal units, each of the pedal units including: a step part on which a corresponding foot part can be put; a base part; and a joint part that is provided between the step part and the base part and couples the step part to the base part in such a way that the step part can do a pitch turn, a roll turn, and a yaw turn with respect to the base part is provided. With the above configuration, supination and pronation of an ankle joint during a lower limb exercise can be achieved.

The joint part of each of the pedal units may include a roll joint part for enabling a roll turn to be conducted, a pitch joint part for enabling a pitch turn to be conducted, and a yaw joint part for enabling a yaw turn to be conducted.

The joint part of each of the pedal units may include, in an order from the step part to the base part, the roll joint part, the pitch joint part, and the yaw joint part.

According to a second aspect of the present disclosure, a pedal unit that can be attached to and detached from a binding pedal, the pedal unit including: a step part on which a corresponding foot part can be put; a base part including a cleat that snap-fits with the binding pedal; and a joint part that is provided between the step part and the base part and couples the step part to the base part in such a way that the step part can do a roll turn and a yaw turn with respect to the base part is provided.

According to the present disclosure, supination and pronation of an ankle joint during a lower limb exercise are achieved.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

It is generally preferable to install a foot-pedaling exercise equipment under a desk to eliminate the lack of daily exercise associated with desk work. That is, if a user uses the foot-pedaling exercise equipment to perform the foot-pedaling exercise in a seated position at his/her desk while working, it is possible to eliminate the lack of daily exercise without having to set aside time for exercise. However, existing foot-pedaling exercise equipment cannot achieve supination and pronation in an ankle joint during a lower limb exercise, so it is cannot be expected that an effect of improving flexibility of the ankle joint will be improved.

The flexibility of an ankle joint is considered essential for forming the arch of the foot part. And the arch of the foot part is supposed to reduce the burden on the knee, mainly by absorbing an impact from the ground when walking. Flexible ankle joints are also considered advantageous for stable walking on rough terrain. For these reasons, it is desirable to achieve supination and pronation in the ankle joint when performing a foot-pedaling exercise using a foot-pedaling exercise equipment. Furthermore, if supination and pronation in the ankle joint can be achieved, an ascending kinetic chain between the lower leg and the pelvis will occur, and the exercise of the trunk muscles represented by the rectus abdominis, transversus abdominis, and erector spinae will be achieved simultaneously.

Techniques for achieving supination and pronation in the ankle joint during the lower limb exercise will be described below in first and second embodiments of this disclosure.

First Embodiment

A first embodiment of this disclosure will be described below with reference to FIGS. 1 to 3.

Figure 1:
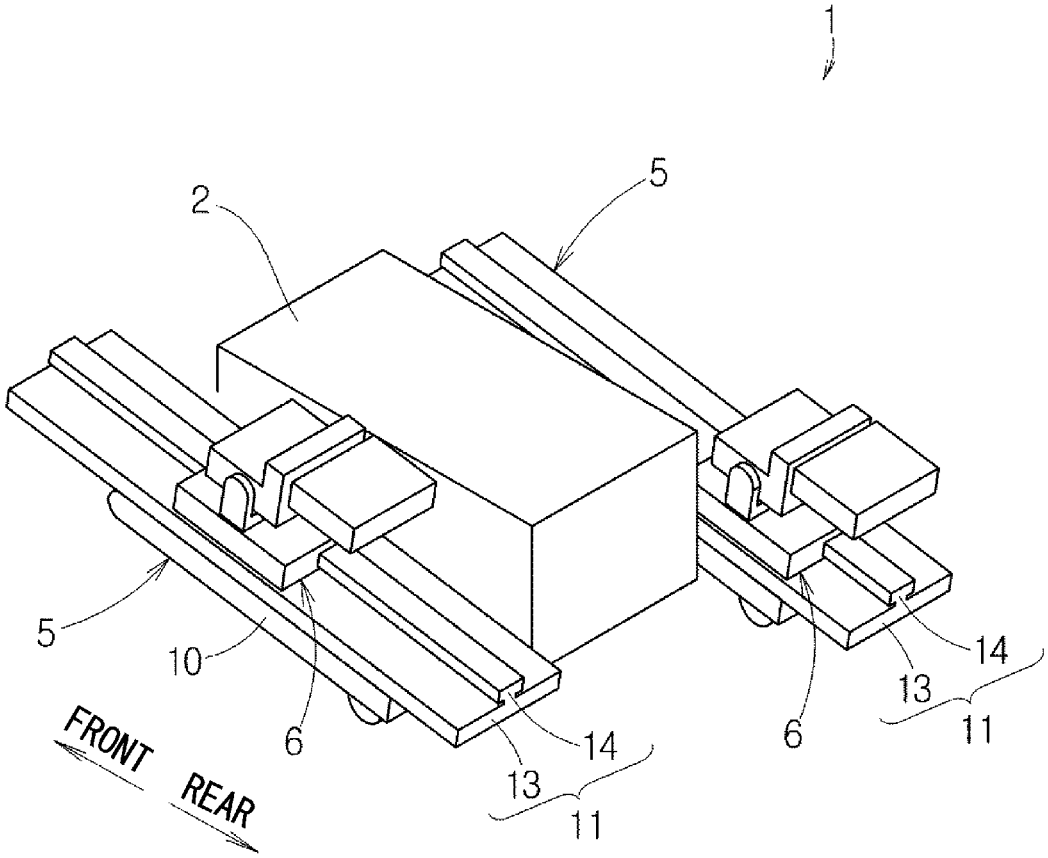
FIG. 1 is a perspective view of a foot-pedaling exercise equipment (first embodiment)
Figure 2:
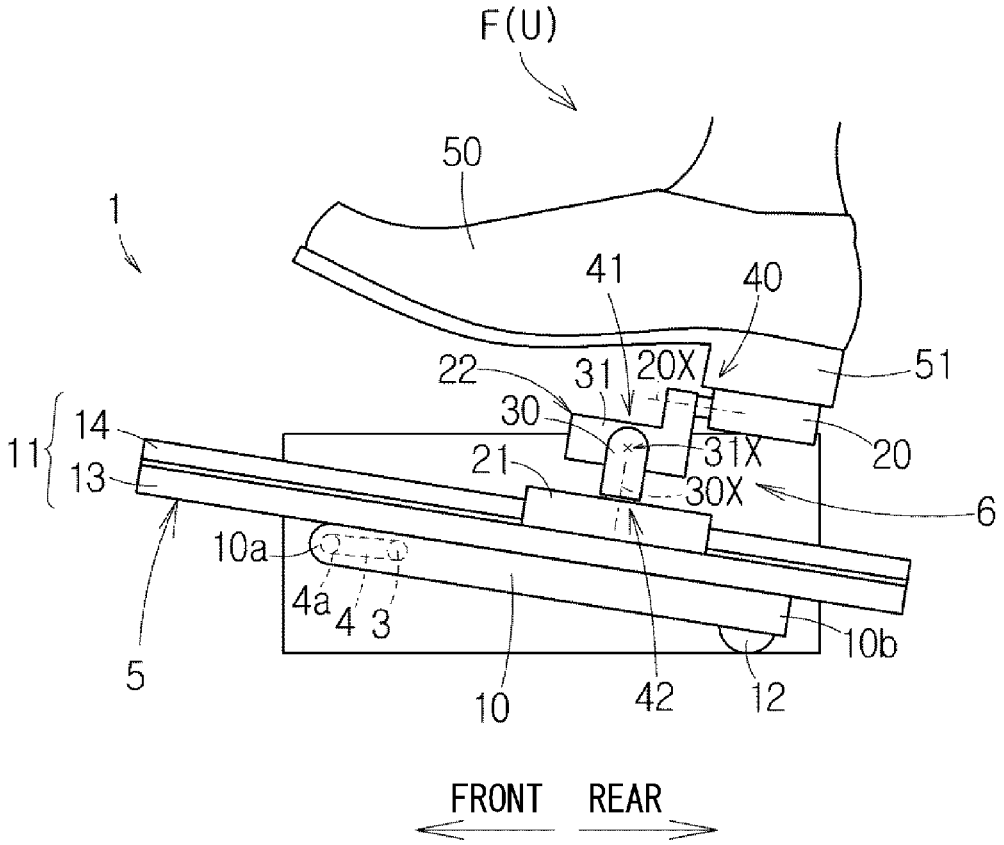
FIG. 2 is a side view of the foot-pedaling exercise equipment (first embodiment)
Figure 3:
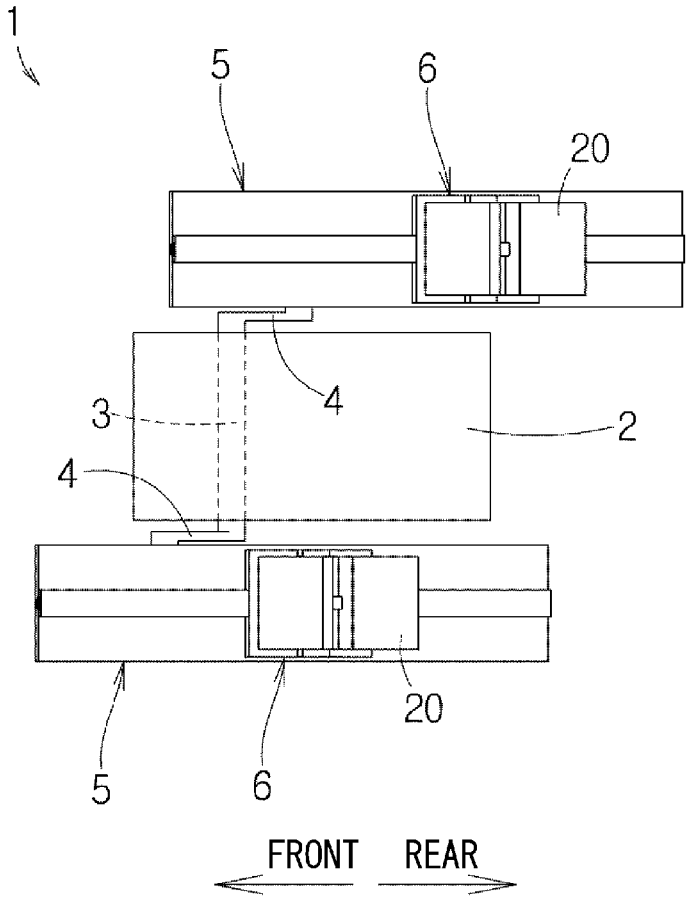
FIG. 3 is a plan view of the foot-pedaling exercise equipment (first embodiment)

FIGS. 1 to 3 show a foot-pedaling exercise equipment 1 as a specific example of a lower limb exercise equipment used for a lower limb exercise. The foot-pedaling exercise equipment 1 is equipment for performing a foot-pedaling exercise in a sitting position, and may be in a form equipped with a chair, such as a bicycle, Aerobike (registered trademark), or a recumbent bike. As a lower limb exercise equipment used for the exercise of the lower limbs, besides the foot-pedaling exercise equipment 1, a stepping exercise equipment may be considered.

As shown in FIGS. 1 to 3, the foot-pedaling exercise equipment 1 includes an equipment main body 2, a shaft 3, a pair of cranks 4, a pair of slide guide units 5, and a pair of pedal unit 6.

As shown in FIG. 3, the shaft 3 is extended in a direction perpendicular to the sagittal plane of the user and is rotatably supported by the equipment main body 2. The equipment main body 2 is equipped with a servomotor with an electromagnetic brake (not shown) that rotates the shaft 3 at a predetermined speed or applies a load to the rotation of the shaft 3. The pair of cranks 4 are extended from both ends of the shaft 3 in a direction perpendicular to the longitudinal direction of the shaft 3 and are extended in directions opposite to each other.

As shown in FIG. 2, each of the slide guide units 5 includes a guide base 10 and a guide main body 11.

A tip 4*a* of the corresponding crank 4 is coupled to a front end 10*a* of the guide base 10 in such a manner that it can freely conduct a pitch turn. A wheel 12 that can freely conduct a pitch turn is provided in a rear end 10*b* of the guide base 10. The wheel 12 typically rolls on the floor on which the foot-pedaling exercise equipment 1 is installed.

The guide main body 11 is extended along the longitudinal direction of the guide base 10. The guide main body 11 includes a rail support plate 13 provided on the guide base 10 and a rail 14 formed on the rail support plate 13.

With the above configuration, the slide guide unit 5 reciprocates back and forth as the shaft 3 rotates. When the slide guide unit 5 moves forward, the front end 10*a* of the guide base 10 passes above the shaft 3. On the other hand, when the slide guide unit 5 moves rearward, the front end 10*a* of the guide base 10 passes below the shaft 3.

Continuing to refer to FIG. 2, the pedal unit 6 includes a step part 20, a base part 21, and a joint part 22.

The step part 20 is a part where the foot part F of the user U is placed.

The base part 21 is supported by the equipment main body 2. The base part 21 is coupled to the rail 14 in such a manner that the base part 21 can be slid with respect to the rail 14. Accordingly, the base part 21 is supported by the equipment main body 2 via the slide guide unit 5, the crank 4, and the shaft 3. However, there may be a configuration in which the slide guide unit 5 is omitted and the base part 21 is directly supported by the crank 4.

The joint part 22 couples the step part 20 to the base part 21 so that the step part 20 can conduct a pitch turn, a roll turn, and a yaw turn with respect to the base part 21. Specifically, the joint part 22 includes a yaw turn part 30 coupled to the base part 21 in such a way that the yaw turn part 30 can conduct a yaw turn relative to the base part 21 and a pitch turn part 31 coupled to the yaw turn part 30 in such a way that the pitch turn part 31 can conduct a yaw turn relative to the yaw turn part 30. And the step part 20 is coupled to the pitch turn part 31 in such a manner that the step part 20 can conduct a roll turn relative to the pitch turn part 31.

A yaw axis 30X at the time of the yaw turn of the yaw turn part 30 is parallel to the thickness direction of the rail support plate 13 in the side view of the foot-pedaling exercise equipment 1 as shown in FIG. 2. A pitch axis 31X at the time of the pitch rotation of the pitch turn part 31 is perpendicular to the yaw axis 30X. A roll axis 20X at the time of the roll turn of the step part 20 is perpendicular to the pitch axis 31X. Therefore, it can be said that the step part 20 has a three-axis degree of freedom with respect to the base part 21. The yaw axis 30X and the roll axis 20X are positioned in the same plane. The roll axis 20X is extended parallel to the foot-length direction.

In this embodiment, the step part 20 and the pitch turn part 31 constitute a roll joint part 40 for enabling the step part 20 to conduct a roll turn relative to the base part 21. The pitch turn part 31 and the yaw turn part 30 constitute a pitch joint part 41 for enabling the step part 20 to conduct a pitch turn relative to the base part 21. And the yaw turn part 30 and the base part 21 constitute a yaw joint part 42 for enabling the step part 20 to conduct a yaw turn relative to the base part 21. And the pedal unit 6 includes, in order from the step part 20 to the base part 21, the roll joint part 40, the pitch joint part 41, and the yaw joint part 42.

The step part 20 is disposed in the rear of the pitch axis 31X. The step part 20 is then screwed onto an outsole 51 of a shoe 50 worn by the user U. Specifically, the step part 20 is screwed to a part of the outsole 51 that is opposed to the rear foot part of the foot part F of the user U. Thus, the midfoot part of the foot part F of the user U is opposed to the pitch axis 31X.

With the above configuration, when the user U kicks the right leg forward, the shaft 3 rotates so that the front end 10*a* of the guide base 10 corresponding to the right leg passes above the shaft 3. At this time, supination occurs in the ankle joint of the right leg. That is, plantarflexion, internal rotation and inversion occur in the ankle joint of the right leg. Meanwhile, the left leg is pulled back. At this time, pronation occurs in the ankle joint of the left leg. That is, dorsiflexion, external rotation, and eversion occur in the ankle joint of the left leg.

Then, when the user U kicks the left leg forward, the shaft 3 rotates so that the front end 10*a* of the guide base 10 corresponding to the left leg passes above the shaft 3. At this time, supination occurs in the ankle joint of the left leg. That is, plantarflexion, internal rotation and inversion occur in the ankle joint of the left leg. Meanwhile, the right leg is pulled back. At this time, pronation occurs in the ankle joint of the right leg. That is, dorsiflexion, external rotation, and eversion occur in the ankle joint of the right leg.

As described above, when the user U alternately kicks the right leg and the left leg forward using the foot-pedaling exercise equipment 1, supination and pronation alternately occur in the ankle joint of the right leg, and supination and pronation alternately occur in the ankle joint of the left leg. The movement of the ankle joint at this time faithfully reproduces the movement of the ankle joint during walking, and as a result, the training effect to increase the flexibility of the ankle joint can be expected.

While the first embodiment has been described above, the above embodiment has the following features.

The pedaling exercise equipment 1 as the lower limb exercise equipment is a lower limb exercise equipment that enables a user to perform lower limb exercise using the pair of pedal units 6. Each of the pedal units 6 includes the step part 20 on which the corresponding foot part F can be placed, the base part 21, and the joint part 22 provided between the step part 20 and the base part 21 and coupling the step part 20 to the base part 21 in such a way that the step part 20 can conduct a pitch turn, a roll turn, and a yaw turn relative to the base part 21. With the above configuration, supination and pronation of the ankle joint during the lower limb exercise can be achieved.

Further, the joint part 22 of each of the pedal units 6 includes the roll joint part 40 for a roll turn, the pitch joint part 41 for a pitch turn, and the yaw joint part 42 for a yaw turn. The joint part 22 of each of the pedal units 6 then includes, in order from the step part 20 to the base part 21, the roll joint part 40, the pitch joint part 41, and the yaw joint part 42. According to the above configuration, the joint part 22 can be obtained with a simple configuration.

However, the above joint part 22 may be, for example, a ball joint. That is, the step part 20 and the base part 21 may be coupled to each other via the ball joint as the joint part.

The above first embodiment may be modified, for example, as follows.

Figure 4:
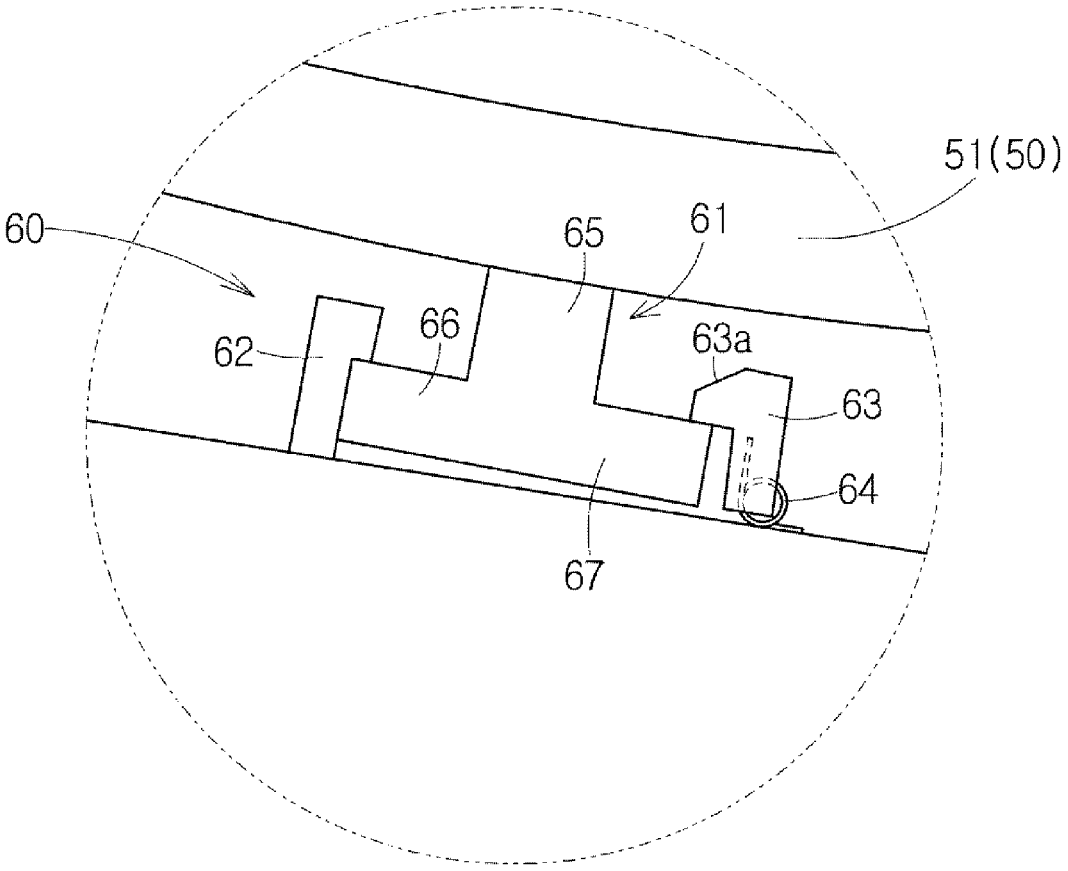
FIG. 4 is an enlarged side view of a foot-pedaling exercise equipment (Modified example)

That is, as shown in FIG. 4, a binding 60 may be provided in the step part and a cleat 61 that can snap-fit with the binding 60 may be provided in the outsole 51 of the shoe 50 so that the shoe 50 can be easily attached to or detached from the step part 20.

As an example, SPD (SHIMANO PEDALING DYNAMICS, registered trademark) may be adopted for the binding 60 and the cleat 61. That is, the binding 60 includes a toe-side hook 62, a heel-side hook 63, and a coil spring 64. The coil spring 64 presses the heel-side hook 63 toward the toe-side hook 62. At the tip of the heel-side hook 63, a fitting guide surface 63*a* is formed. The cleat 61 includes a support part 65, a front cleat 66, and a rear cleat 67. The support part 65 is extended downward from the outsole 51. The front cleat 66 is extended forward from the support part 65. The rear cleat 67 is extended rearward from the support part 65. With the configuration described above, when the user steps on the heel with the front cleat 66 hooked to the toe-side hook 62, the rear cleat 67 moves the heel-side hook 63 rearward while sliding along the fitting guide surface 63*a* of the heel-side hook 63. When the rear cleat 67 moves over the fitting guide surface 63*a*, the spring restoring force of the coil spring 64 moves the heel-side hook 63 forward. As a result, the rear cleat 67 is captured by the heel-side hook 63. This causes the cleat 61 to snap-fit with the binding 60.

Second Embodiment

Figure 5:
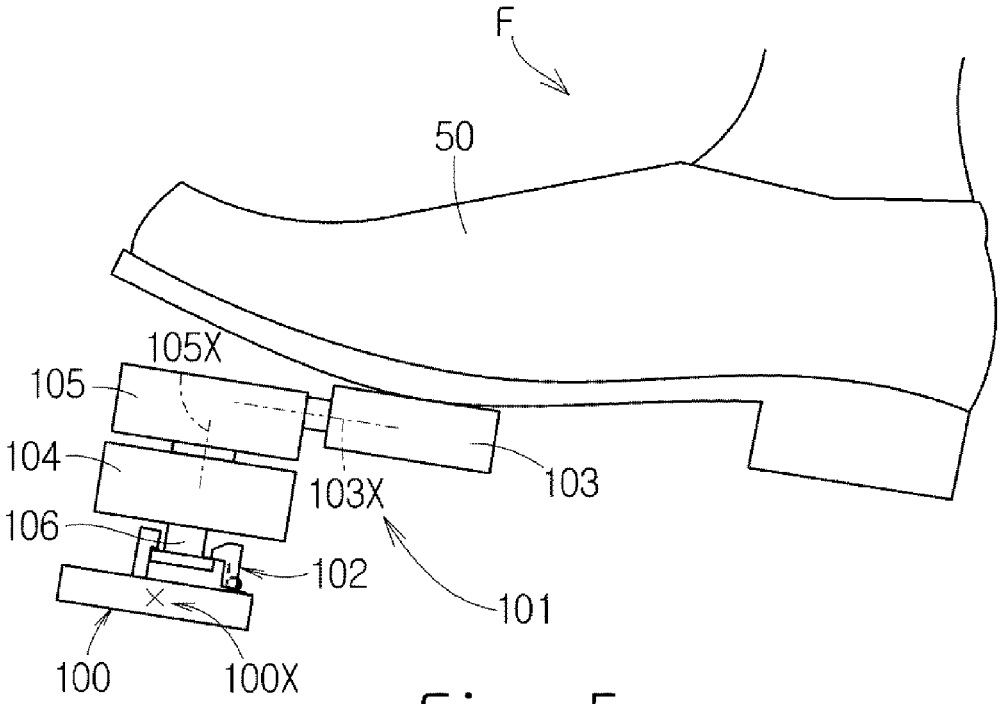
FIG. 5 is a side view of a pedal unit that snap-fits with a binding pedal (second embodiment).

Next, a second embodiment of this disclosure will be described with reference to FIG. 5. FIG. 5 shows a side view of a pedal unit 101 that snap-fits with a binding pedal 100.

The binding pedal 100 is generally a pedal with a binding 102 that conforms to SPD (SHIMANO PEDALING DYNAMICS, registered trademark). Since the structure of the binding 102 is the same as that of the binding 60 shown in FIG. 4, the description thereof is omitted.

The pedal unit 101 includes a step part 103, a base part 104, and a joint part 105. The step part 103 is a part on which the corresponding foot part F is placed. The base part 104 includes a cleat 106 that snap-fits with the binding 102. Since the structure of the cleat 106 is the same as that of the cleat 61 shown in FIG. 4, the description thereof is omitted.

The joint part 105 is provided between the step part 103 and the base part 104. The joint part 105 couples the step part 103 to the base part 104 so that the step part 103 can conduct a roll turn and a yaw turn relative to the base part 104.

Specifically, the joint part 105 is configured to be able to conduct a yaw turn relative to the base part 104. And the step part 103 is coupled to the joint part 105 in such a way that the step part 103 can conduct a roll turn relative to the joint part 105.

A yaw turn axis 105X of the joint part 105 is perpendicular to a pitch turn axis 100X of the binding pedal 100. A roll turn axis 103X of the step part 103 is perpendicular to the yaw turn axis 105X. Therefore, it can be said that the step part 103 has a three-axis degree of freedom with the pitch turn axis 100X, the yaw turn axis 105X, and the roll turn axis 103X.

According to this embodiment, pronation and supination of the ankle joint can be achieved by simply replacing the pedal of the existing lower limb exercise equipment with the binding pedal 100 and snap-fitting the pedal unit 101 with the binding 102 of the binding pedal 100. Therefore, the introduction cost in achieving pronation and supination of the ankle joint can be reduced.

As described above, the second embodiment has the following characteristics.

That is, the pedal unit 101 that can be attached to and detached from the binding pedal 100 includes the step part 103 on which the corresponding foot part F can be placed, the base part 104 including the cleat 106 that snap-fits with the binding pedal 100, and the joint part 105 provided between the step part 103 and the base part 104 and coupling the step part 103 to the base part 104 in such a way that the step part 103 can conduct a roll turn and a yaw turn relative to the base part 104. According to the above configuration, since the binding pedal 100 itself is originally able to conduct a pitch turn, supination and pronation of an ankle joint during a lower limb exercise can be achieved.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A lower limb exercise equipment that enables a lower limb exercise to be performed using a pair of pedal units, each of the pedal units comprising:

a step part configured to receive a foot of a user;

a base part; and a joint part that is provided between the step part and the base part and couples the step part to the base part in such a way that the step part is capable of doing a pitch turn, a roll turn, and a yaw turn with respect to the base part, wherein the step part is configured to be screwed to a part of an outsole of a shoe worn by the user, wherein the part of the outsole to which the step part is configured to be screwed faces a rearfoot of the user such that a midfoot of the user is aligned with a pitch axis of the pitch turn.

2. The lower limb exercise equipment according to claim 1, wherein the joint part of each of the pedal units comprises a roll joint part for enabling a roll turn to be conducted, a pitch joint part for enabling a pitch turn to be conducted, and a yaw joint part for enabling a yaw turn to be conducted.

3. The lower limb exercise equipment according to claim 2, wherein the joint part of each of the pedal units comprises, in an order from the step part to the base part, the roll joint part, the pitch joint part, and the yaw joint part.

4. The lower limb exercise equipment according to claim 1, wherein:

the step part is configured to be screwed to the part of the outsole at a position rearward of the joint part along a foot-length direction.

* * * * *